US006409570B1

(12) United States Patent
Thate

(10) Patent No.: US 6,409,570 B1
(45) Date of Patent: Jun. 25, 2002

(54) TETHERED TOP

(76) Inventor: Robert James Thate, 519 Red Birch Rd., Millersville, MD (US) 21108

( * ) Notice: Subject to any disclaimer, the term of this patent is extended or adjusted under 35 U.S.C. 154(b) by 0 days.

(21) Appl. No.: 09/703,401

(22) Filed: Nov. 1, 2000

Related U.S. Application Data

(60) Provisional application No. 60/162,756, filed on Nov. 1, 1999.

(51) Int. Cl.[7] ..... A63H 1/08
(52) U.S. Cl. ..... 446/262; 446/256; 446/236
(58) Field of Search ..... 446/236, 256, 446/259, 261–264

(56) References Cited

U.S. PATENT DOCUMENTS 420,755 A * 2/1890 Williams
644,709 A * 3/1900 Henry
1,108,725 A * 8/1914 Duncan
3,352,055 A * 11/1967 Pelkowski
3,392,482 A * 7/1968 Nathan
4,891,031 A * 1/1990 Beaudry
5,024,625 A * 6/1991 MacCarthy

FOREIGN PATENT DOCUMENTS

GB 2191416 A * 12/1987

* cited by examiner

*Primary Examiner*—Jacob K. Ackun
*Assistant Examiner*—Bena B. Miller
(74) *Attorney, Agent, or Firm*—G. Kevin Townsend; William S. Ramsey

(57) ABSTRACT

A tethered top is provided with a construction by which it can be accelerated, controlled and/or manipulated using a tether that remains attached to one end of the top, top body, or spindle. The tether can optionally be used as a pull string to be wrapped around top or spindle to impart acceleration to the top. The tether remains attached to at least one end of the top via at least one low friction housing connector but does not substantially retard the top's rotation, either when spinning on a surface or as supported in the air by the attached tether, low friction housing connector, and/or spindle.

16 Claims, 5 Drawing Sheets

TETHERED TOP

CROSS-REFERENCE TO RELATED APPLICATIONS

This application claims the benefit of priority from provisional application Ser. No. 60/162,756, filed Nov. 1, 1999.

FIELD OF INVENTION

This invention relates to spinning toys, particularly tops.

BACKGROUND OF THE INVENTION

The background art describes tops but does not appear to provide or describe a top whose location, attitude and/or orientation can be manipulated, controlled or modified by a user without substantially disrupting or inhibiting the speed and/or stability of the top's rotation. Accordingly, there is a need to provide a top that can be remotely and/or mechanically manipulated to provide interaction between the user and the top while it continues to spin substantially unimpeded.

SUMMARY OF THE INVENTION

A tethered top of the present invention comprises at least one top body, at least one spindle, at least one tether, and at least one low friction housing connector that is mounted for substantially free rotation along at least one axis of the at least one top body. When the tethered top spins, at least one low friction housing connected to at least one tether rotates within or without the top body at low friction. At least one tether is attached to at least one low friction housing connector operably associated with at least one spindle or top body having at least one tip for surface contact at one or both ends of the spindle and/or the top. The tether attachment to the spindle (e.g., a low friction housing connector) has low friction such that the attached tether does not interfere substantially with the spin of the top, such that the spindle can spin with sufficient centripetal force to continue spinning for several seconds to several or many minutes.

The top body optionally further comprises an internal or external tether receiving groove, shaft, tube, member, or indentation that allows the tether to be wound around or inside the top body or the tether attachment to optionally initiate the spin of the top by the unwinding of the tether. Alternatively, the tether can be wound inside the top body and can be unwound as the top is spun so that the tether optionally remains unwound while the top is spinning. The winding of the tether can be via an automatic winding mechanism (such as a spring or other suitable winder) or via a manual mechanism (such as using a winding crank or any other suitable mechanism).

Once initiated, the spinning tethered top of the present invention can stand on a surface at or on either end while the tether remains attached to the low friction housing connector of the tethered top, or the spinning top can be supported by the user in mid-air by the tether itself as it attaches to the low friction connector housing. The user of the top can also manipulate the position or location of the spinning top by moving the attached tether, either when the spinning top is supported by a surface at the spindle tip, or when the spinning top is being suspended in mid-air by the tether.

It is among the general objects of the invention to provide a top that can be manipulated once spinning, by the use of the tether that remains attached to the top.

Another object of the invention is to provide a tethered top that displays high performance and long spinning times while remaining tethered.

Another object of the invention is to provide a tethered top that is easily and quickly spun using the attached tether to optionally initiate the spin of the top.

Another object of the invention is to provide a versatile amusement toy that is of simple, low, moderate or commercially viable cost and method of manufacture, assembly and/or construction.

DESCRIPTION OF DRAWINGS

The foregoing and other objects and features of the invention will be appreciated more fully from the following further description and accompanying drawings wherein.

DESCRIPTION OF THE INVENTION

Figure 1:
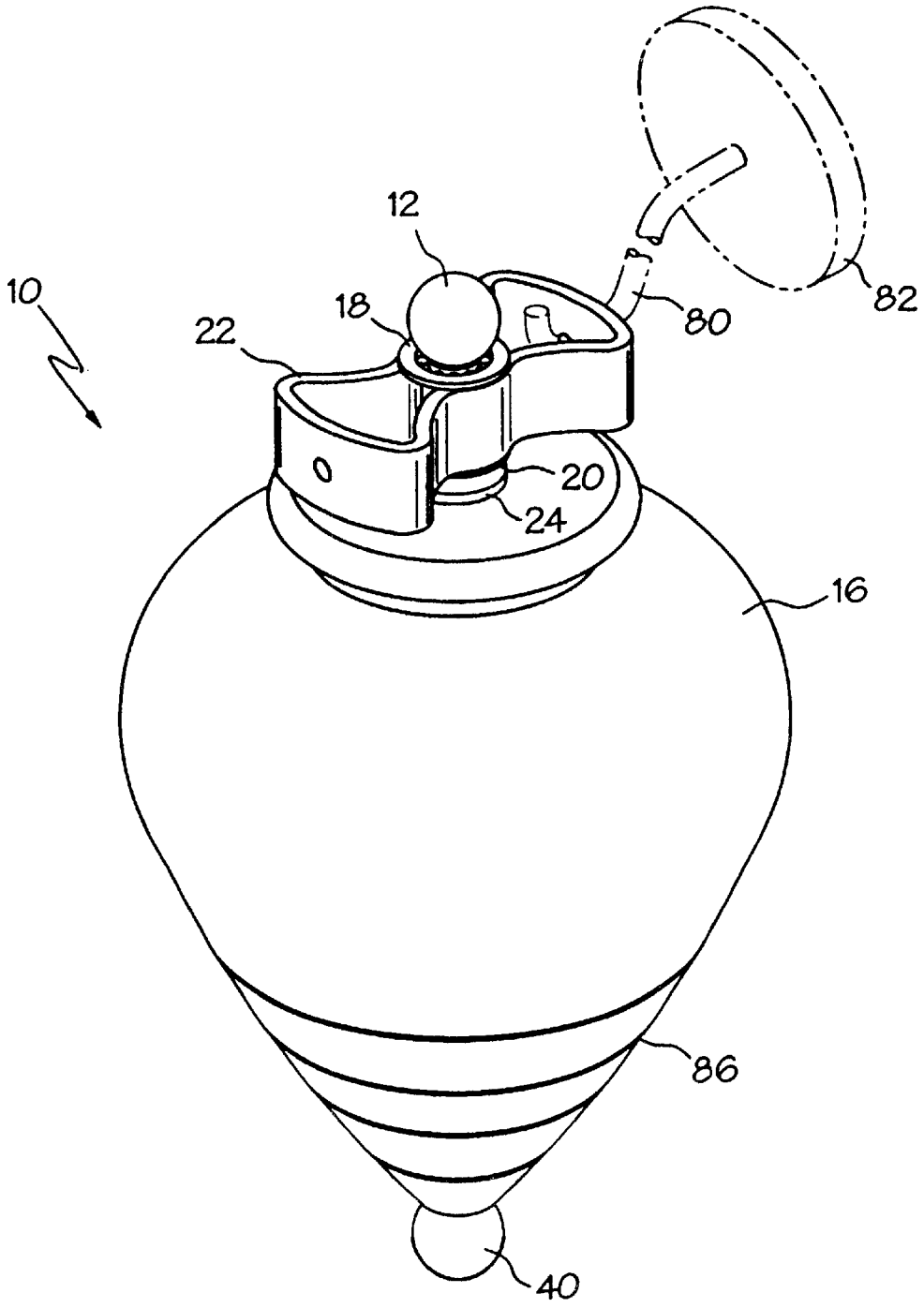
FIG. 1 is a perspective illustration of one, non-limiting, example of a tethered top 10 according to the present invention, wherein the tethered top 10 is tethered by a tether 80 (having a tether handle 82) via fly wing 22 that connects to the tethered top 10 via an upper flanged bearing 18 and a lower flanged bearing 20 supported by a crush sleeve 24, around an upper axle 12. The lower spindle axle 14 (not shown) and the upper spindle axle 12 each comprise a spinning sphere tip (30 and 40, respectively) that can contact the surface on which the top spins.

The present invention provides a tethered top that can be played with while the top is spinning to manipulate the position or orientation of the top while it is spinning as supported by a surface or as supported by at least one tether. The top can optionally spin on either end and can be flipped while it is spinning to spin on its opposite end or as supported by the tether. The utility of a tethered top is thus for recreation or play, or to observe or teach physical properties of spinning tops, such as centripetal forces.

As shown in the drawings, the top includes at least one top body, at least one low friction housing, at least one spindle and at least one tether, which allows the spindle to rotate independently of the top body. The tethered top comprises at least one top body, having along at least one axis, at least one spindle having at least one spinning tip for surface contact at one or both ends of the tethered top, the spindle having at least one low friction housing connector operably connected near one end of the spindle to at least one end of the tether, wherein the tether can be manipulated to modify the position of the top without substantially inhibiting the spinning of the top on a surface or hanging by the tether.

The top can be made according to any known process using any suitable material, such as, but not limited to, at least one of plastic, a wood, a metal, a resin, a glass, a polymer, and a plant derived material. The material can be any color or combination of colors, such as but not limited to, white, black, blue, red, yellow, green, purple, orange, turquoise, pink, lime, sienna, gold, silver, copper, and the like, as well as fluorescent and glow in the dark colors, earth colors, metallic or neon colors. The material can be molded, machined, sculpted, shaped, carved, cut, blown, mixed, formed, reacted, polymerized, heated, cooled, and the like, as suitable for the particular material, part, component, use or commercial utility. Such materials and methods are well known in the art.

The top body optionally comprises at least one external or internal member, groove or indentation 86 that allows the tether to be wound around the top body or spindle to be used to optionally initiate spinning of the tethered top. The low friction housing connector can comprise at least one bearing of low friction connector, as known in the art. Alternatively or optionally, the spindle optionally further comprises at least one bearing or low friction connector, and/or where the at least one spindle is operably connected to the low friction housing connector. Alternatively or optionally, the spindle tip is operably connected to the top body.

Preferably and optionally, the top body comprises a bore or center bore formed axially within the body and alternatively or optionally defining a spindle cylinder space for the spindle. The tethered top preferably comprises at least one material selected from the group consisting of a plastic, a wood, a metal, a resin, a glass, a polymer, and a plant derived material. Alternately or optionally, the low friction housing connector comprises a fly wing that can spin substantially independently of the spindle and/or the body. The low friction housing connector further alternatively or optionally comprises at least one bearing or low friction connector. Alternatively or optionally, the low friction connector further comprises at least one tether attachment.

The tethered top alternatively or optionally further comprises at least on tether handle at the end of the tether. The tether handle can facilitate the manipulation of the top's position by the tether. The handle can be any suitable shape or material, such as but not limited to, at least one of round, cylindrical, spherical, flat, tubular, rectangular, square, ring-containing, hook-like, rough, smooth, and the like, or any combination thereof. The handle material can also be any suitable material, e.g., as described herein or as known in the art.

The top body alternatively or optionally further comprises at least one slot, groove, indentation, tube, or tunnel for winding or housing the tether or for initiating spinning of the top. The spinning tip can comprise at least one of a round, pointed, flat or tapered shape, or any combination thereof.

A non-limiting example of the tethered top is also provided as a preferred embodiment (which the invention is not limited to, however), the top comprising a top body having along its longitudinal axis a center bore and defining a spindle cylinder space for a spindle, the center bore ending, respectively, at the center of both an upper surface and a lower surface of the top body, the top body further optionally comprising grooves or indentations for winding a tether to initiate the spinning of the top; an upper spindle and a lower spindle inserted into the center bore at the upper surface and the lower surface, respectively, each spindle having a spinning tip for surface contact at the respective ends of the tethered top, the spindle axle further comprising a spindle axle shaft and a spindle axle end opposite the spindle tip; a low friction housing connector comprising (i) a fly wing having a tether attachment, (ii) a lower flanged bearing, (iii) an upper flanged bearing, and (iv) a crush sleeve, the low friction housing connector operably connected around the upper spindle axle shaft between the upper spindle tip and the upper surface of the top body; at least one tether attached to the tether attachment of the fly wing; the tether optionally further comprising a tether handle at its end opposite to the tether attachment, wherein (a) the lower spindle is positioned into the center bore of the lower surface of the top body; (b) the upper spindle is positioned into the center bore of the upper surface of the top body; (c) the low friction housing connector spins substantially independently of the upper spindle; (d) the upper and lower spindles spin substantially connected to the top body; and (e) the tether is optionally manipulated to modify the position of the top without substantially inhibiting the spinning of the top on a surface or hanging by the tether.

The present invention also provides packaging comprising at least one tethered top as described herein, such as 1–1,000,000, or any range or value therein. The packaging material comprising a tethered top of the present invention can include any suitable material used for storage, manufacture, shipping, exporting, importing, marketing, advertising, promoting or selling, or any other assembly, manufacture or commercial use. The packaging material can be any combination of any suitable material, such as but not limited to, at least one of a plastic (clear or opaque), a paper, a cardboard, a metal, a resin, a plant derived material, a glass, a wood, a wood/glue mixture and the like.

The present invention also provided a method for making a tethered top according to the present invention, comprising assembling the tethered top comprising at least the components of the at least one top body, the at least one spindle, the at least one low friction housing and at least one tether. Such methods are well known in the art and any suitable method or method step can be used as part of the present invention.

The present invention also provides a method for making a tethered top according to the present invention, comprising manufacturing the tethered top comprising at least the components of the at least one top body, the at least one spindle the at least one low friction housing and at least one tether. Such methods are well known in the art, and any suitable method or method step can be used as part of the present invention.

In one non-limiting example of a tethered top of the present invention, a tethered top is provided that is described in at least one of FIGS. 1–7. The tethered top can spin on either end, either as supported by a surface or by the tether. Once the top is spun it can spin on one end or be flipped while spinning to spin on the opposite end. In the non-limiting example, the top or any component thereof can be made of at least one of a wood, a plastic, a metal, a glass, a resin, a polymer, a plant derived material, or any other suitable material.

As shown in FIG. 1, one example of a tethered top 10 according to the present invention comprises a tether 80 (having a tether handle 82) connected via a fly wing tether attachment 84 to a fly wing 22 to the top body 16 via an upper flanged bearing 18 and a lower flanged bearing 20 supported by a crush sleeve 24, each around the upper spindle axle shaft 32 of the upper axle 12 which sits in the bearing housing surface 54 of the fly wing 22. The end of the tether 80, opposite the tether attachment 84, is the tether handle 82 that allows the user to handle, hold or control the position or orientation of the top via the tether 80. The lower spindle axle 14 and the upper spindle axle 12 each comprise a spinning sphere tip at their external ends (30 and 40, respectively) that can contact the surface on which the top spins and support the top while it spins.

Figure 2:
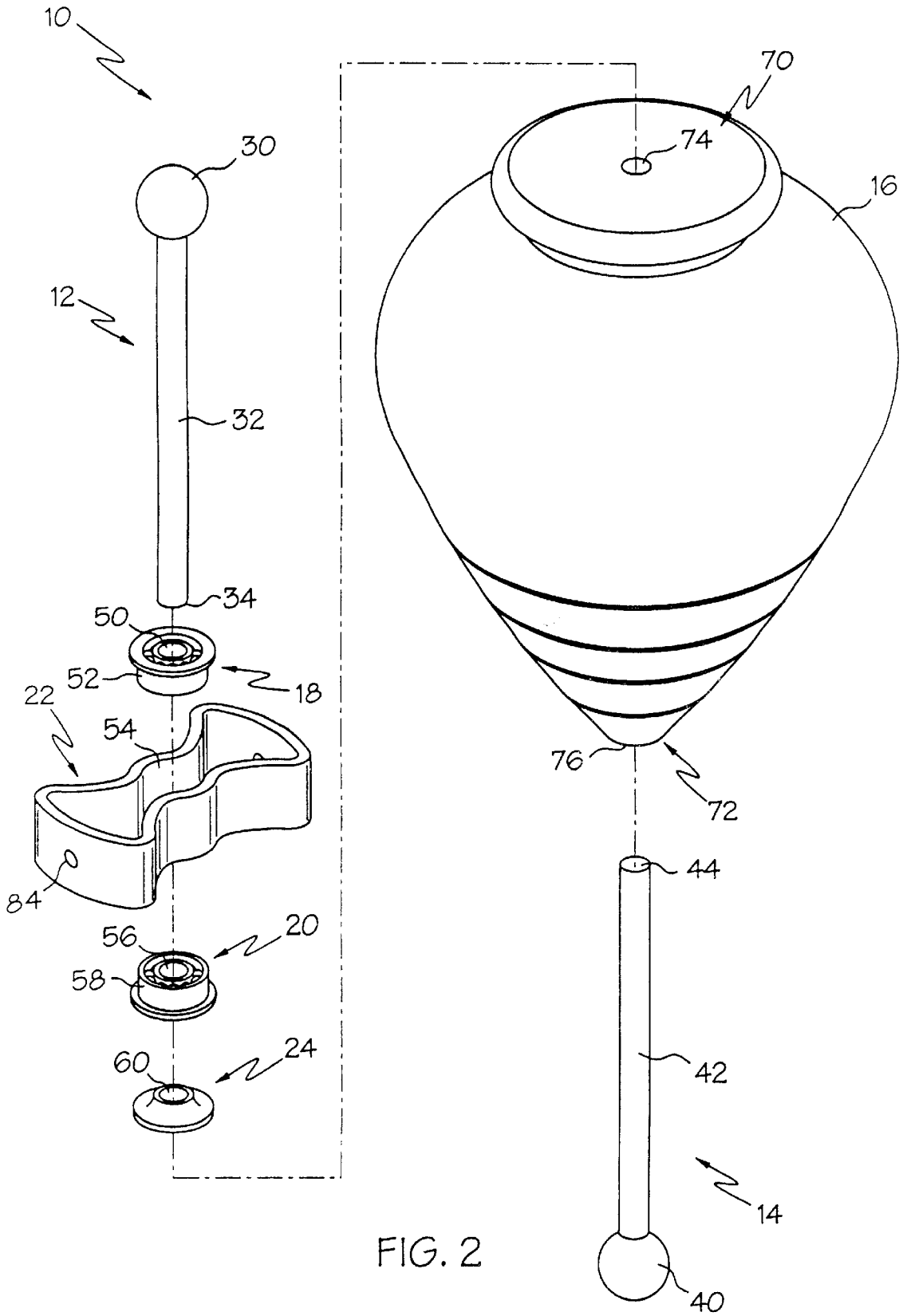
FIG. 2 is an exploded view of the tethered top shown in FIG.1, with the upper spindle axle 12, upper and lower flanged bearings 18 and 20, fly wing 22, and lower spindle axle 14 shown in exploded view with further aspects shown.

An exploded view of the tethered top 10 shown in FIG. 1 is shown in FIG. 2, where the upper spindle axle 12, upper and lower flanged bearings 18 and 20, fly wing 22, and lower spindle axle 14, are shown in exploded view. The upper spindle axle 12 comprises a spinning sphere tip at the top, operably attached to the upper spindle axle shaft 32 ending in the upper spindle lower end 34. The upper-flanged bearing 18 comprises an inner race 50 and a bearing housing 52 comprising bearing. The upper flanged bearing inserts into the upper portion of the bearing housing surface 54 of the fly wing 22 which further comprises at least one fly wing tether attachment 84 for the tether 80. The lower portion of the bearing housing surface 54 (of the fly wing 22) has inserted into it the lower flanged bearing 20, comprising an inner race 56 and bearing housing 58 comprising bearings. The bearings can be free in the bearing housing or can be encased. Suitable low friction components can also be used instead of bearings as known in the art. The upper spindle lower end 34 of the upper spindle axle shaft 32 inserts through the upper flange bearing 18 and lower flanged bearing 20, both housed in the bearing holding surface 54 of the fly wing 22, continuing to insert through the crush sleeve 60. After inserting through the upper flanged bearing 18, fly wing 22, lower flanged bearing 20, and crush sleeve 24, the upper spindle axle shaft 32 inserts into the top body 16 at the upper center bore opening 74 of the upper top surface 70.

As also shown in FIG. 2, the lower spindle axle 14, comprising the spinning sphere tip 40, the axle shaft 42, and the lower spindle end 44, inserts at the spindle end 44 into the enter bore opening 76 of the lower surface 72 of the top body 16

Figure 3:
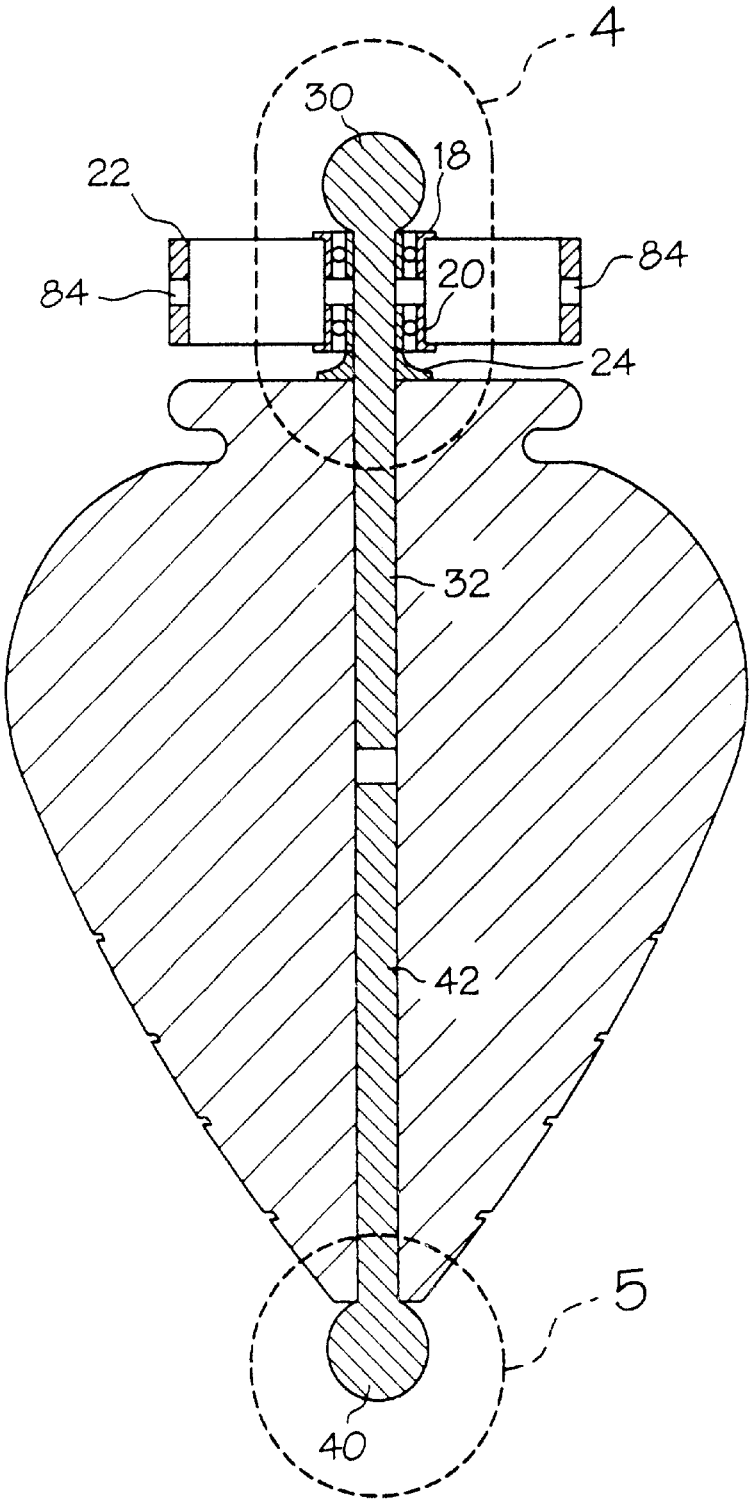
FIG. 3 is a cross-sectional illustration of the tethered top shown in FIGS. 1 and 2, further showing the detail illustrations of FIGS. 4 and 5.
Figure 4:
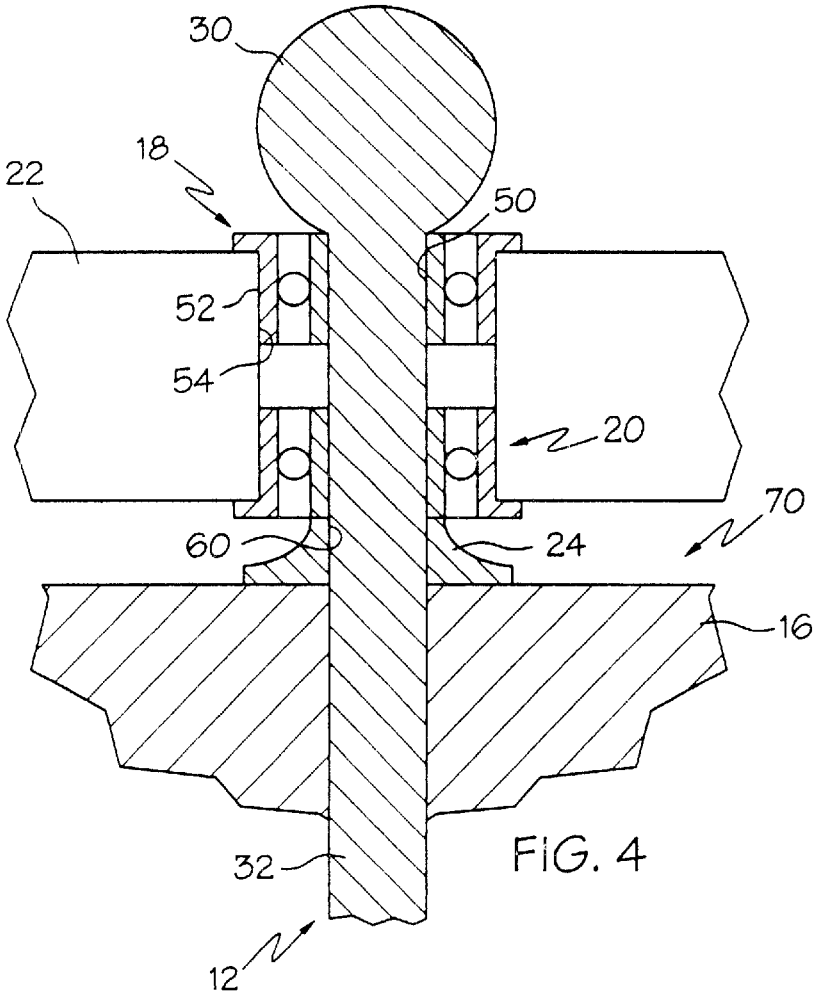
FIG. 4 is a detail cross-sectional illustration from FIG. 3, showing the upper spindle axle 12 inserted into the center bore opening 74 of the upper top surface 70 of the tethered top 10, with the crush sleeve 24, lower flanged bearing 20, fly wing 22, and upper flanged bearing 18, located around the upper spindle axle 12 between the upper top surface 70 and the spinning sphere tip 30 of the upper spindle axle 12.
Figure 5:
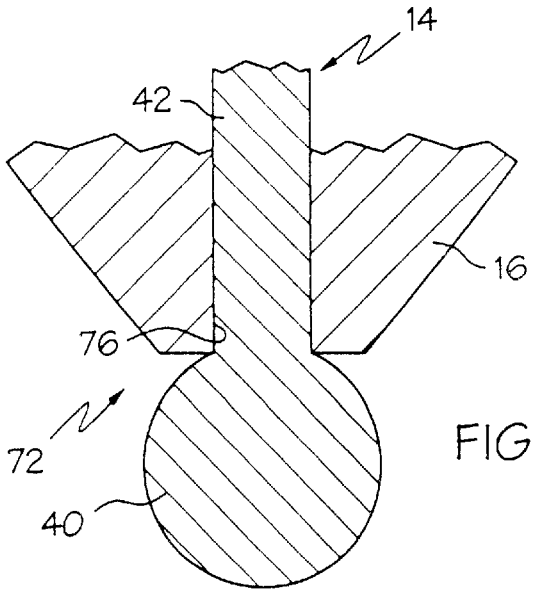
FIG. 5 is a detail cross-sectional illustration from FIG. 3, showing the lower spindle axle 14 inserted into the center bore opening 76 of the lower top surface 72, inserted up the spinning sphere tip 40 of the lower spindle axle 14.

FIG. 3 is cross-sectional illustration of the tethered top shown in FIGS. 1 and 2, further showing the detail illustrations of FIGS. 4 and 5. FIG. 3 shows the insertion of the lower and upper spindle axles 12 and 14 into the top body 16. FIG. 4 is detail cross-sectional illustration from FIG. 3, showing the upper spindle axle 12 (comprising the spindle sphere 30, and the spindle axle shaft 32) inserted into the center bore opening 74 of the upper top surface 70 of the top body 16, with the crush sleeve 24, lower flanged bearing 20, fly wing 22, and upper flanged bearing 18, located around the upper spindle axle shaft 32 between the upper top surface 70 and the spinning sphere tip 30 of the upper spindle axle 12. The upper flanged bearing 18 and the lower flanged bearing 20 are shown with their respective inner races 50 and 56 around the upper axle shaft 32 and inside the bearing housing surface 54 of the fly wing 22.

The fly wing 22 thus spins substantially independent of the upper spindle axle 12, which spins substantially the same as the spinning of the top 10, thus allowing the tether 80 attached to the fly wing 22 to not wrap substantially around the top as the top spins. Therefore, the tether can be used to control the position of the top while it is spinning without substantially inhibiting the spin of the top. FIG. 5 is a detail cross-sectional illustration from FIG. 3, showing the lower spindle axle 14 inserted into the center bore opening 76 of the lower top surface 72, inserted up to the spinning sphere tip 40 of the lower spindle axle 14.

Figure 6:
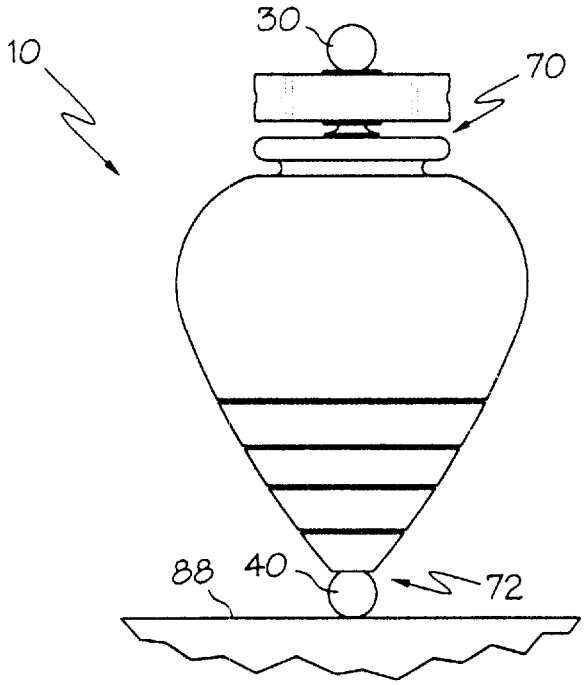
FIG. 6 is a side view of the tethered top shown I FIGS. 1–5, where the tethered top 10 is spinning on the spinning sphere tip 40 of the lower spindle axle 14 on a surface.
Figure 7:
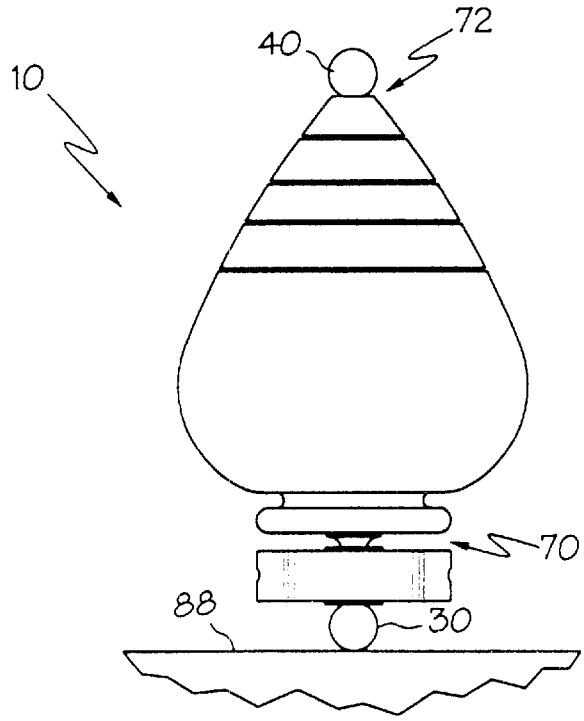
FIG. 7 is a side view of the tethered top shown in FIGS. 1–5, where the tethered top 10 spinning on the spinning sphere tip 30 of the upper spindle axle 12 on a surface.

Side views of the tethered top shown in FIGS. 1–5 are shown in FIGS. 6–7. These views show how a top according to the present invention can be spun on either end. FIG. 6 is a side view of the tethered top shown in FIGS. 1–5, where the tethered top 10 is spinning on the spinning sphere tip 40 of the lower spindle axle 14 on a surface 88. FIG. 7 is a side view of the tethered top shown in FIGS. 1–5, where the tethered top 10 is spinning on the spinning sphere tip 30 of the upper spindle axle 12 on a surface.

From the foregoing, it will be appreciated that the invention provides a versatile, multi-use toy that provide a remote-manipulatable tethered top. The device is capable of a high degree of performance. It is inexpensive and simple to make use.

It should be understood, however, that the foregoing description of the invention is intended merely to be illustrative thereof and that other modifications and embodiments may be apparent to those skilled in the art without departing from its spirit.

What is claimed is:

1. A tethered top, comprising:

a top body, at least one spindle having a spinning tip for surface contact at one end of the spindle, the spindle mounted coaxially with the top body with the spinning tip extending from the top body, a low friction housing connector, the low friction housing connector connected to the spindle, a tether having a first and a second end, the tether connected to the low friction housing connector at the first end, and the tether wrapped around the top body.

2. The tethered top of claim 1, wherein the housing connector comprises an inner race, a bearing housing, and a multiplicity of ball bearings.

3. The tethered top of claim 1 wherein the low friction housing connector comprises low friction components.

4. The tethered top of claim 1 wherein a tether handle is attached to the second end of the tether.

5. The tethered top of claim 4 wherein the tether handle is round, cylindrical, spherical, flat, tubular, rectangular, square, ring-containing, hook-like, rough or smooth.

6. The tethered top of claim 1 wherein the spinning tip has a round, pointed, flat or tapered shape.

7. The tethered top of claim 1 wherein the spinning tip has a round shape.

8. The tethered top of claim 1 wherein the top body is constructed of wood, plastic, metal, resin, glass, or polymer.

9. The tethered top of claim 1 wherein the top body is constructed of wood.

10. The tethered top of claim 1 wherein the top body is molded, machined, sculpted, shaped, carved, cut, blown, mixed, formed, reacted, or polymerized.

11. The tethered top of claim 1 wherein the top body is colored white, black, blue, red, yellow, green, purple, orange, turquoise, pink, lime, sienna, gold, silver, or copper.

12. The tethered top of claim 1 wherein the top body further comprises a slot, groove, indentation, tube or tunnel for wrapping the tether about the top body.

13. The tethered top of claim 1 wherein the top body has a center bore extending into the longitudinal axis of the top body from an upper surface or a lower surface of the top body and the spindle is inserted in the center bore with the spinning tip of the spindle extending from the top body.

14. The tethered top of claim 13 wherein the spinning tip of the spindle extends from the upper surface of the top body.

15. The tethered top of claim 13 wherein the spinning tip of the spindle extends from the lower surface of the top body.

16. A tethered top comprising, a top body having along its longitudinal axis two coaxial center bores, one center bore ending at the center of both an upper surface and a lower surface of the top body, the top body having grooves or indentations for winding a tether to initiate the spinning of the top, an upper spindle inserted into a first one of the coaxial center bores at the upper surface and having a spinning tip at the upper surface of the top body, a lower spindle inserted into a second one of the coaxial center bores at the lower surface and having a spinning tip at the lower surface of the top body, each of the lower and upper spindle further comprising a spindles axle shaft, a low friction housing connector comprising: a fly wing having a tether attachment, a lower flanged bearing, an upper flanged bearing, and a crush sleeve, the low friction housing connector connected about the upper spindle axle shaft between the upper spindle tip and the upper surface of the top body, a tether connected to the tether attachment of the fly wing, the tether comprising a handle at a tether end opposite to the tether attachment, and the tether wrapped around the top body.

* * * * *